US006065807A

United States Patent [19]

Going et al.

[11] Patent Number: 6,065,807

[45] **Date of Patent: *May 23, 2000**

[54] ADJUSTABLE FOOT SUPPORT

[75] Inventors: Patricia Going, York, Me.; Julie Cicalis, Bridgewater, Mass.; Michael Green, Portsmouth, N.H.

[73] Assignee: Advanced Therapeutic Resources, Amesbury, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 09/213,181

[22] Filed: Dec. 17, 1998

[51] Int. Cl.[7] ..... A47C 16/00

[52] U.S. Cl. ..... 297/423.41; 297/423.44; 211/37

[58] Field of Search ..... 297/3, 423.39, 297/423.41, 423.44; 211/34, 37; 248/163.1

[56] References Cited

U.S. PATENT DOCUMENTS

| | | |
|---|---|---|
| D. 92,703 | 7/1934 | Crego . |
| D. 139,504 | 11/1944 | Sadler . |
| D. 367,968 | 3/1996 | Hatcher . |
| 1,104,360 | 7/1914 | Kusterer . |
| 3,016,267 | 1/1962 | Cones . |
| 3,119,356 | 1/1964 | Sauer . |
| 3,132,835 | 5/1964 | Drabert . |
| 3,653,715 | 4/1972 | Drabert et al. . |
| 5,356,203 | 10/1994 | Levasseur et al. . |
| 5,626,393 | 5/1997 | Levasseur et al. . |

*Primary Examiner*—Anthony D. Barfield

*Attorney, Agent, or Firm*—David D. Lowry; Brown, Rudnick, Freed & Gesmer, P.C.

[57] ABSTRACT

An adjustable foot support provides several user selectable heights to accommodate a wide variety of users. The adjustable foot support includes two ends, with several support surfaces extending from the first end to the second end. The ends are generally triangular in shape. Any of the three sides may be used as a base against a floor, wherein support surfaces at different heights are usable for supporting a user's foot or other object. The support surfaces include flat surfaces which are substantially horizontal when the appropriate corresponding side is used as a base.

6 Claims, 2 Drawing Sheets

ADJUSTABLE FOOT SUPPORT

BACKGROUND

Many manual and industrial jobs require an operator or worker to stand at a machine or station for long periods of time. Such standing causes fatigue, as well as stress and stiffness, particularly in the back and the legs. Such stresses can often lead to chronic back problems, and injuries due to stiffness and inflexibility.

Physical therapists and occupational therapists have spent many years studying the human body and physiology in attempting to provide a comfortable work environment with minimal stress and fatigue. One technique for persons who stand for long periods is to provide a foot support, allowing a worker to rest one foot on a raised platform, which helps relieve the strain of standing for a long time. The worker can shift from one foot to the other. Foot supports are well known and commonly used, an example being the brass rail common in bars and eating establishments.

While foot supports are a beneficial feature, the height of the foot support is problematic. Generally, a comfortable height for raising one foot off the ground varies from person to person. A standard "one size fits all" foot support simply does not provide a useful aid to people of different sizes and preferences. Taller people prefer a higher foot support than average or short people. Plus personal preference for a foot support height also varies. In a factory where many different workers use a machine or workstation, such as different work shifts, a foot support fixed at one height will not provide the best positioning for each worker.

Many adjustable foot rests are available, wherein the height of the platform for the person's foot can be raised or lowered to accommodate different requirements. However, many of the adjustment mechanisms are very difficult and time consuming to adjust. A worker often needs to remove connectors or wing nuts to adjust a height, or crank up or down a screw type mechanism, or even adjust a ratchet mechanism to raise the foot platform.

Even more problematic, a worker must often bend down to the foot support to manually adjust the foot support with their hands. A worker who must spend several minutes bent down to a foot support to adjust it would prefer simply not to bother. Especially in a factory condition, the floor where the foot support was located is probably dirty and poorly lit. If the machine produces debris, such as metal shavings from a drilling station, the floor area is very messy. Finally, many of these adjustable foot supports are not very sturdy, and will not survive long in an industrial environment, especially if complicated height adjustment mechanisms are included.

SUMMARY

The present invention is directed towards an adjustable foot support which is strong, lightweight, portable and can easily be adjusted to many different heights. A person does not even have to bend down to adjust it. The adjustable foot support is also extremely easy to use and understand, and accommodates a variety of different heights thereby being usable by a large number of people. Other advantages include a sturdy platform which will not slip or shake as it is used, and is easy to manufacture.

The present invention includes an adjustable foot support apparatus which comprises a first and second end, and three sides. Each side includes a support surface extending substantially from the first end to the second end, wherein each support surface is positioned a predetermined length away from another side, and each predetermined length is different.

A prior U.S. Pat. No. 3,016,267 issued to B. Cones describes a foot rest consisting of a long section of tubular material such as steel which is bent into a generally triangular-shaped support. The foot rest includes a bottom side 10 which is weighted down to maintain a steady position on the floor and two different height bars to accommodate a person two different heights to be used for resting a foot. The person can use the one or the other height by spinning the unit around to face the other way by bringing the other bar 14 or 15 up to the person's foot. Only two different heights are available. More than two heights are not possible without departing from Cone's teachings of a simple bent tubular material.

Further, the Cones' foot support does not teach or make obvious the feature of using different sides of the triangular-shaped surface to serve as the base (in contact to the floor), as a way to provide different heights. In fact, if the Cones patent was placed on another side, the adjustable height of the foot support 14 or 15 would not work since they depend upon measurements from the bottom base 10. Also, Cones does not provide a flat surface on the foot supports 14, 15 for better grip by a shoe. Cones simply discloses the circular metal tube which would not provide a secure grip or a large surface area for contact with the bottom of a foot.

BRIEF DESCRIPTION OF THE DRAWINGS

The foregoing and other features and advantages of the present invention will be more fully understood from the following detailed description of illustrative embodiments, taken in conjunction with the accompanying drawings in which.

DETAILED DESCRIPTION

Figure 1:
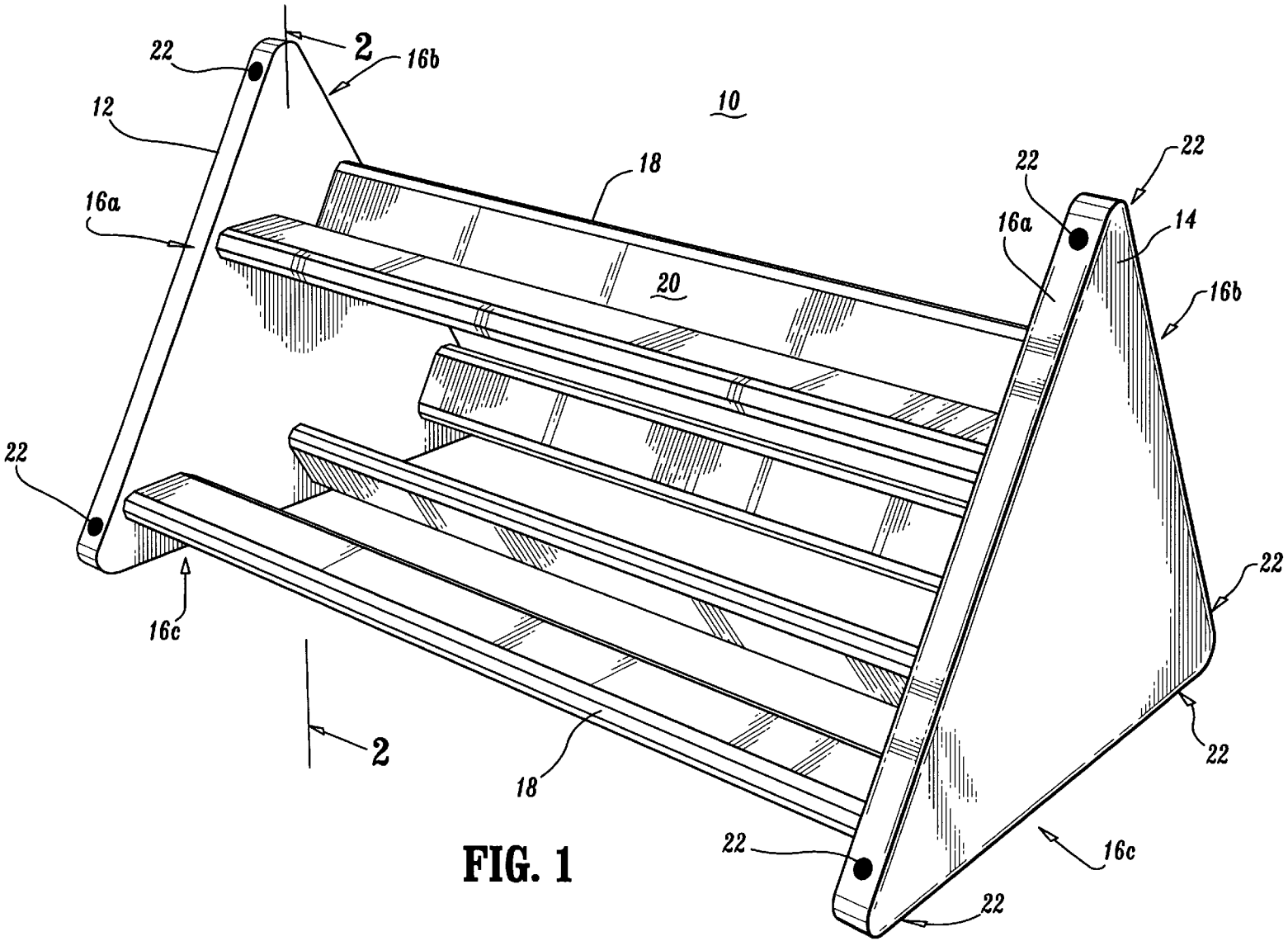
FIG. 1 is a view of an illustrative embodiment of an adjustable support according to the present invention.

An illustrative embodiment of the adjustable foot support 10 is shown in FIG. 1. The apparatus includes a first and second end sections 12 and 14. These end sections are generally triangular in shape, although other shapes such as square or pentagon may be employed. Extending from the first end section 12 to the second end section 14 are a plurality of support surfaces 18. These support surfaces 18 may be any shape including round or square. Preferably, the support surfaces 18 include at least one substantially flat surface 20.

Because of their shape, the end sections 12 and 14 allow any of the three sides 16*a–c* serve as a base resting on the floor. For example, side 16*a* of end sections 12 and 14 can serve as the base against the floor, or alternatively 16*b* may be used or 16*c*. Depending on which side 16*a–c* is used as the base for the adjustable foot support 10, the support surfaces 18 are positioned to provide different selectable heights, as will be described below. The end sections 12 and 14 may also include non-skid pads 22 to prevent slipping. These non-skid pads 22 may be small circles as shown or may extend along the entire side, (16*a*, 16*b* and 16*c*) of the end sections 12 and 14. Also, the surfaces including the flat surface 20 of the support surfaces 18 can also include non-skid surface material.

Figure 2:
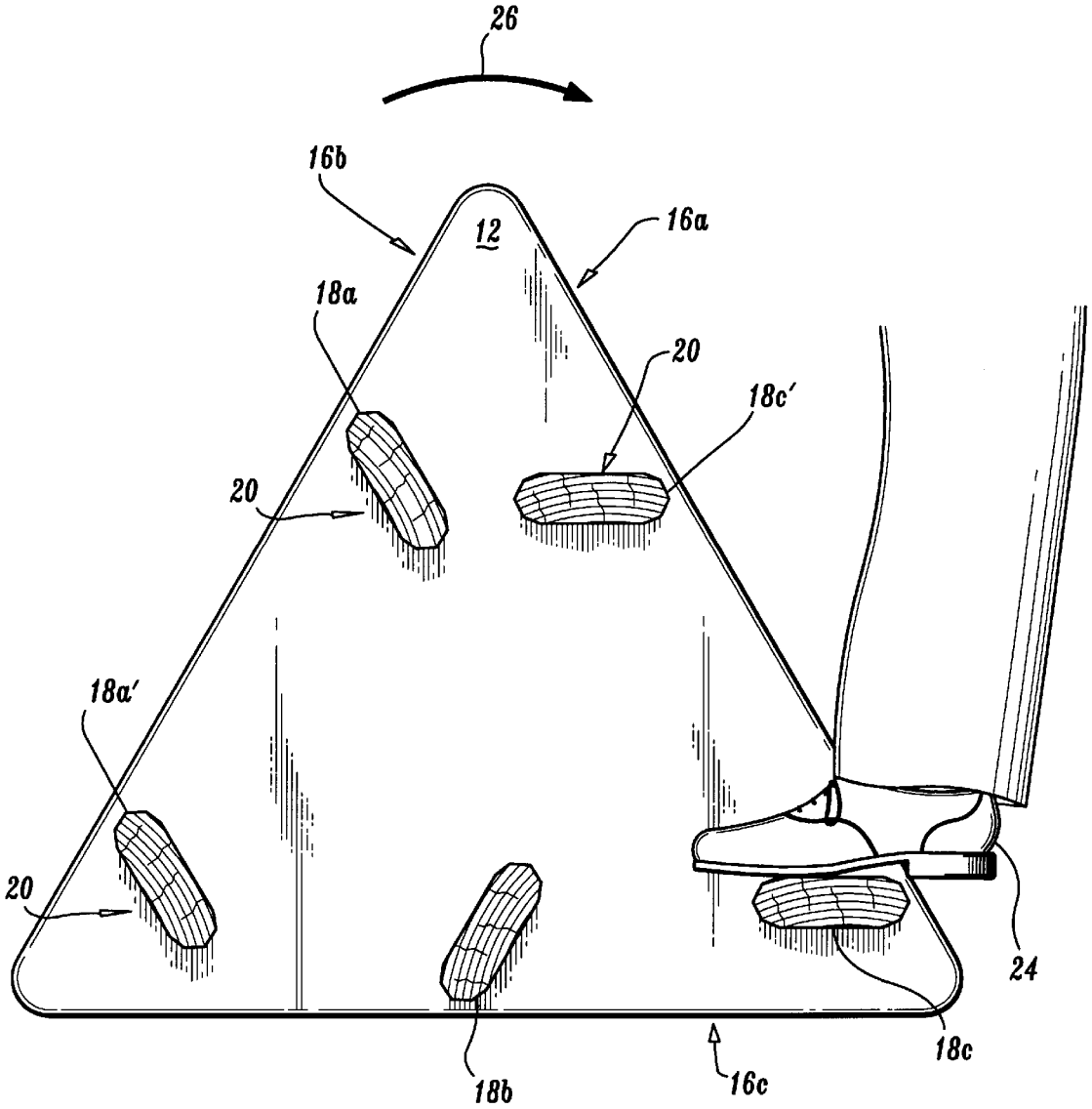
FIG. 2 is an end view of the illustrative embodiment shown in FIG. 1.

Turning now to FIG. 2, the use of the illustrative embodiment of the foot support 10 is illustrated. With side 16*c* in contact with the floor, two different support surfaces, 18*c* and 18*c*$^1$ are available to the user, as illustrated by a user's foot 24. When the adjustable foot support 10 is rotated or flipped so side 16*b* is placed against the floor, then support surface 18*b* is available for a foot support surface, and at a different height than the previous two choices. Further, rotating the unit so that side 16*a* is in contact with the floor, support surfaces 18*a* and 18*a*$^1$ are available as foot supports.

In this way, simply rotating the adjustable foot support 10 provides a plurality of different heights to accommodate any users' preference. For the illustrative embodiment, five different heights are available. The lowest height is provided when side 16*c* is used as a base and support surface 18*c* is used. The next higher position is provided by support surface 18*a*, when side 16*a* is used as a base. The middle height is provided by support surface 18*b*, which is used when side 16*b* is used as a base. The next two increased heights are provided by using side 16*c* as the base and 18*c*[1] as a support surface and then finally using 16*a* as the base and support surface 18*a*[1] as the top height. Therefore, five different heights are provided to accommodate a great number of different users.

Another elegant feature of the present invention is that a user simply rotates the adjustable foot support 10 in one direction to obtain consecutively higher heights. In other words, if the adjustable foot support 10 is in the positions so that the lowest support surface 18*c* is available, a worker simply rotates the unit in the direction as shown by arrow 26 (clockwise, when viewed from end section 12) to get to the next step up in height, and can continues rotating until the preferable height for support surface 18 is found.

In selecting a preferred height, a user does not have to bend down to the floor where the adjustable foot support 10 is located. The user simply needs to rotate the unit using their leg by either hooking the foot under a support surface 18, or pushing the top of the unit over with their foot. Once positioned, the foot support apparatus 10 will form a secure, solid base due to the large base to height rate ratio of the end sections 12 and 14. Therefore the unit is sturdy and will not tip over or shake.

Although the illustrative embodiment shows five support surfaces 18 wherein two support surfaces are available when two sides are used and one support surface is available when the third side is used, fewer or greater support surfaces 18 may be used.

Further, the support surfaces 18 are preferably positioned so that they have a flat surface 20 available on top to support a foot on when the corresponding base is against the floor. For example, when side 16*c* is against the floor, the support surfaces 18*c* and 18*c*[1] have the flat surface 20 available on top, and substantially horizontal, to easily support and provide a sure gripping surface for a foot or shoe, or other supported object. Subsequently, if the side 16*a* is used as the base, support surfaces 18*a* and 18*a*[1] have surfaces 20 which would be presented in the upright direction due to the fact they are parallel with the side 16A.

The present invention may be constructed out of any strong material including wood, molded plastic, metal, carbon fiber, reinforced cardboard, etc. The illustrative embodiment is 24 inches in length from end section 12 to end section 14 with the triangular end sections being 14 inches along each side, forming an equilateral triangle. The corners of the triangle may be smoothed out, as illustrated, or cut off flat. The support surfaces 18 are 22 inches long and 2.5 inches wide. Other dimensions are possible and may change for example, to accommodate different work station designs. A non-skid surface material may be applied to the support surfaces 18, including the flat surfaces 20. The foot support surfaces may be reinforced, for example, including a third "end" section (not shown) in the middle, connecting the support surfaces 18 together thereby providing extra strength at the center. The support surfaces 18 may also be reinforced at any point along the way with connecting bars connecting the various support surfaces together in such a way as not to interfere with a foot. A center bar may also extend from the center of the first end 12 to the second end 14 to also reinforce the adjustable foot support 10. Alternatively, the center of the end sections 12 and 14 may have material removed thereby lightening the end sections where material is not needed to anchor the support surfaces 18 (not shown).

The height of the support surfaces 18 in the illustrative embodiment are 2, 4, 6, 8 and 10 inches when measured from the appropriate base 16. For different applications, different heights may be used and are within the scope of this invention. The support surfaces are grouped with the 2 and 8 inch heights on one side, the 6 inch height on another side, and the 4 and 10 inch height on the third side.

The present invention has utility outside of the field of foot support. The support surfaces 18 may be used to raise rigid objects, such as scaffolding or blocks, to various heights above a surface. For example, two supports 10 can be used to support an object such as a plank or block at either end, and allow minute adjustments in height as necessary to make the object level. Finally, the flat surfaces 20 may be adjusted to different angles if a level flat surface is not desired. For example, if a foot support is to be used with a chair, the angle may be adjusted up or down anywhere from 0 to 90 degrees to more accommodate the angle of a resting foot or a heel as appropriate for the intended use. Further, the angle of the support surfaces 18 may be adjustable by a user employing a device allowing the angle to be changed and then locked in place, such as a screw device or ratchet.

Although the invention has been shown and described with respect to illustrative embodiments thereof, various other changes, omissions and additions in the form and detail thereof may be made therein without departing from the spirit and scope of the invention.

What is claimed is:

1. An apparatus for supporting a foot above a surface comprising:

a first and second end;

at least three equal-length sides, each side usable as a stable contact base to said surface, each side further including at least one foot support surface, each foot support surface extending substantially from said first end to said second end, and positioned a selected distance from another one of said sides, wherein each of said selected distances from another one of said sides is different.

2. The apparatus of claim 1 wherein at least one of said foot support surfaces includes a substantially flat surface which is parallel to another one of said sides.

3. An adjustable stable foot support apparatus comprising:

a first and second end;

three equal-length sides, each side usable as a stable base on a floor, and each side including a foot support surface extending substantially from said first end to said second end, wherein each foot support surface is positioned a predetermined length away from another side, and each predetermined length is different.

4. The apparatus of claim 3 wherein at least one of said foot support surfaces includes a flat surface at an angle that is substantially parallel with said another side.

5. The apparatus of claim 3 wherein at least one of said foot support surfaces includes a flat surface at a substantially horizontal angle when said apparatus is placed on a horizontal surface.

6. The apparatus of claim 3 wherein rotating said apparatus in one direction to allow each side to act as a base respectively presents one of said foot support surfaces at an increasing height.

* * * * *